United States Patent [19]

Rudick et al.

[11] Patent Number: 4,802,343

[45] Date of Patent: Feb. 7, 1989

[54] SELF-COOLING CONTAINER

[75] Inventors: Arthur G. Rudick, Marietta; Richard H. Heenan, Atlanta; Ashis S. Gupta, Marietta, all of Ga.

[73] Assignee: The Coca-Cola Company, Atlanta, Ga.

[21] Appl. No.: 68,876

[22] Filed: Jul. 1, 1987

[51] Int. Cl.[4] ..... F25D 3/10

[52] U.S. Cl. ..... 62/294; 62/4; 62/394; 62/400

[58] Field of Search ..... 62/4, 294, 394, 400

[56] References Cited

U.S. PATENT DOCUMENTS

| | | | |
|---|---|---|---|
| 1,897,723 | 2/1933 | Free . | |
| 2,460,765 | 2/1949 | Palaith | 62/92 |
| 2,556,893 | 6/1951 | Zwiebach et al. | 62/92 |
| 2,746,265 | 5/1956 | Mills | 62/94 |
| 2,757,517 | 8/1956 | Goldberg | 62/92 |
| 2,805,556 | 9/1957 | Wang | 62/92 |
| 2,882,691 | 4/1959 | Robbins | 62/4 |
| 2,900,808 | 8/1959 | Wang | 62/294 |
| 3,229,478 | 1/1966 | Alonso | 62/371 |
| 3,269,141 | 8/1966 | Weiss | 62/294 |
| 3,309,890 | 3/1967 | Barnett et al. | 62/294 |
| 3,326,013 | 6/1967 | Jacobs | 62/294 |
| 3,338,067 | 8/1967 | Warner | 62/264 |
| 3,373,581 | 3/1968 | Strader | 62/294 |
| 3,494,142 | 2/1970 | Beck | 62/294 |
| 3,494,143 | 2/1970 | Barnett et al. | 62/294 |
| 3,520,148 | 7/1970 | Fuerle | 62/294 |
| 3,525,236 | 8/1970 | Solhkhah | 62/294 |
| 3,597,937 | 8/1971 | Parks | 62/294 |
| 3,620,406 | 11/1971 | Evans | 220/44 |
| 3,636,726 | 1/1972 | Rosenfeld et al. | 62/294 |
| 3,726,106 | 4/1973 | Jaeger | 62/294 |
| 3,759,060 | 9/1973 | Chase | 62/294 |
| 3,803,867 | 4/1974 | Willis | 62/294 |
| 3,842,617 | 10/1974 | Chase et al. | 62/294 |
| 3,852,975 | 12/1974 | Beck | 62/294 |
| 3,881,321 | 5/1975 | Riley | 62/294 |
| 3,889,483 | 6/1975 | Donnelly | 62/4 |
| 3,919,856 | 11/1975 | Beck | 62/60 |
| 3,987,643 | 10/1976 | Willis | 62/371 |
| 4,204,613 | 5/1980 | Terzian et al. | 62/400 X |
| 4,407,356 | 10/1983 | DeLau | 62/400 X |
| 4,478,346 | 10/1984 | Spong | 62/400 X |
| 4,599,872 | 7/1986 | Rist | 62/400 X |

*Primary Examiner*—Lloyd L. King

[57] ABSTRACT

A self-cooling container is provided having a hollow body with a cooling chamber and directing means for directing the flow of a portion of a beverage therein in contact with the cooling chamber to cool predominantly the next-to-be-consumed portion of the beverage.

29 Claims, 3 Drawing Sheets

SELF-COOLING CONTAINER

BACKGROUND OF THE INVENTION

1. Field of the Invention

The present invention generally relates to self-cooling containers and, more particularly, relates to a self-cooling container having a directing means for cooling a predetermined portion of a consumable beverage.

2. Description of the Art

Many beverages available in portable containers are preferably consumed when they are chilled. For example, carbonated soft drinks, fruit drinks, beer and the like are preferably consumed at temperatures varying between 33° F. and 50° F. When the convenience of refrigerators or ice is not available such as when fishing, camping or the like, the task of cooling these beverages prior to consumption is made more difficult. In such circumstances, it is highly desirable to have a method for rapidly cooling the containers prior to consumption. Thus, a self-cooling container, one not requiring external low temperature conditions, is desirable.

The art is replete with container designs which incorporate a coolant capable of cooling the contents without exposure to the external low temperature conditions. The vast majority of these containers, incorporate or otherwise utilize refrigerant gases which, upon release or activation absorb heat in order to cool the contents of the container. Other techniques have recognized the use of endothermic chemical reactions as a mechanism to absorb heat and thereby cool the contents of the container. For example, U.S. Pat. Nos. 1,897,723, 2,746,265, and 2,882,691 utilize a cooling mechanism wherein two materials chemically react when mixed to absorb heat.

However, none of these conventional techniques or containers have been previously commercialized because of various economic, health and safety problems. Further, all of the prior art techniques attempt to cool the entire contents of the container upon cooling. This often requires substantial time between activating the cooling process and cooling the beverage causing the consumer to wait additional time before consumption.

The present invention mitigates the problems associated with the prior techniques by providing self-cooling container capable of (i) being adapted into current container manufacturing techniques (ii) utilizing a simple and safe cooling mechanism, and (iii) reducing the time required to consume cool beverage. Accordingly, the present invention cools predominantly the next-to-be-consumed portion of the beverage rather than attempting to cool the entire contents.

SUMMARY OF THE INVENTION

It is an object of the invention to provide a self-cooling container which is safe, convenient to use and economical to manufacture.

Another object of the present invention is to provide a self-cooling container which cools predominantly the next-to-be-consumed portion of the beverage.

It is another object of this invention to provide a self-cooling container which can be introduced into the container manufacturing industries without major alterations in manufacturing machinery or equipment.

It is yet a further object of this invention to employ an endothermic chemical reaction with inexpensive materials as a self-contained cooling mechanism.

Still a further object of this invention is to provide a self-cooling container which can be easily and safely actuated to initiate the cooling process.

Thus, the present invention provides a self-cooling container comprising:

a. a hollow body for the storage of a beverage, b. opening means on the hollow body for, providing an opening therein for dispensing the beverage therethrough, c. a cooling chamber within the hollow body and affixed thereto and having cooling means therein, and d. directing means for directing the beverage to flow into contact with the cooling chamber prior to being dispensed from the container.

BRIEF DESCRIPTION OF THE DRAWINGS

The objects of the present invention and the associated advantages thereof will become readily apparent from the following detailed description when taken in conjunction with the following drawings.

DETAILED DESCRIPTION OF THE INVENTION

Figure 1:
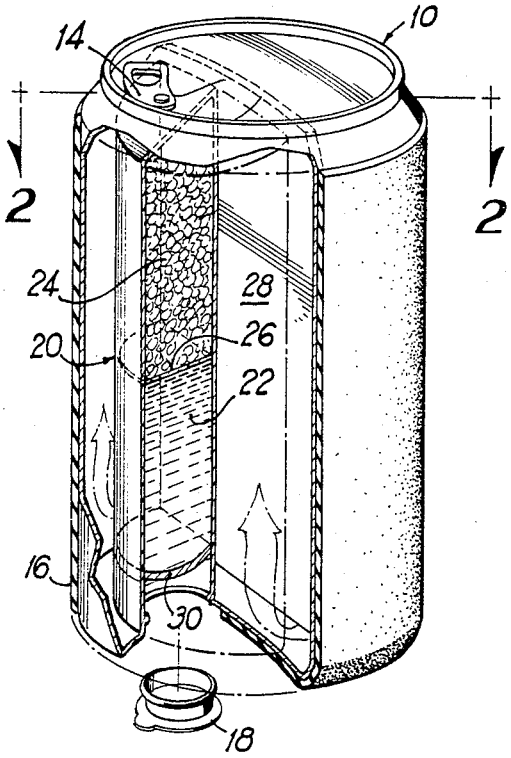
FIG. 1 is perspective cross-sectional side view of one embodiment of the present invention.
Figure 2:
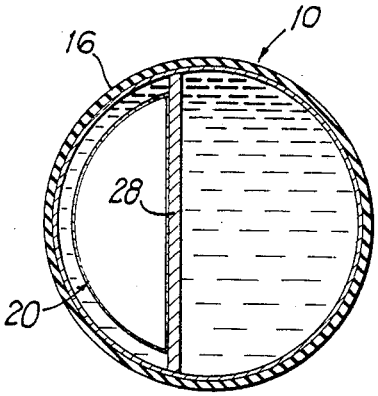
FIG. 2 is a cross-sectional top view of the self-cooling container of FIG. 1.

With reference to the drawings, FIGS. 1 and 2 show a self-cooling container 10 particularly suited for the storage of carbonated soft drinks, fruit drinks, beer and the like. Preferably, the container 10 is a can and is constructed of conventional materials such as aluminum, steel, plastic or the like. The container 10 has a hollow body 12, an opening means 14, optional insulation means 16, an openable closure means 18, a directing means 28 and a cooling chamber 20. The opening means 14 is typically a pull-tab or pop-top as known in the art. The openable closure means 18 provides a tamper-evident function and means to prevent accidental activation of the cooling mechanism.

The cooling chamber 20 is positioned to provide a narrow passageway between it and the outer wall of hollow body 12 and is adjacent to openable closure means 18. The cooling chamber 20 can contain either a refrigerant gas or, preferably, a chemical capable of reacting upon activation to absorb heat. Refrigerant gases are well known in art and include carbon dioxide, hydrocarbons and the like. If refrigerant gases are employed, means for allowing venting of the gases such as any conventional valve (not shown) will be located through openable closure means 18. The preferred cooling mechanism is a chemical cooling means as shown in FIG. 1 and described below.

Accordingly, the cooling chamber 20 has two compartments 22 and 24 which are separated by a rupturable separator means 26. The cooling chamber 20 includes a flexible rolling diaphragm 30 in contact with the liquid in compartment 22 which can be exposed by opening openable closure means 18. The openable closure means 18 can be any material which will prevent access to the flexible rolling diaphragm 30 until properly opened or removed. Typically, the openable closure means 18 is an adhesive foil, a plastic cap, or the like which is peeled back, opened or otherwise removed by the consumer.

The compartment 22 of cooling chamber 20 contains a suitable liquid which will both react when in contact with the chemical contained in compartment 24 and transmit pressure exerted on flexible rolling diaphragm 30 to rupturable separator means 26. Typically, the liquid employed will be water although other liquids, either organic or inorganic, can be employed depending on the chemical chosen for compartment 22. The chemical in compartment 24 is selected so as to react with the liquid in compartment 22 upon contact to thereby absorb heat. This reaction, known as an endothermic reaction, is the cooling mechanism which will cool the beverage in hollow body 12 by heat transfer through the wall of cooling chamber 20. Thus, the cooling chamber 20 is constructed of any suitable heat transfer material including, but not limited to, steel, aluminum or metal alloys.

Suitable chemicals for use in compartment 24 can be any material which reacts with the liquid in compartment 22 to absorb heat. Such chemicals are well known in the art. When the liquid is water, typical materials include inorganic salts such as alkali metal halides, perchlorates, ammonium salts or the like. The preferred chemical is ammonium nitrate when the liquid is water.

The directing means 28 extends across the circumference of container 10 from the top of container 10 to a position short of the bottom. The directing means 28 directs the flow of beverage such that the beverage flows below the directing means 28 and up between the side of container 10 and the cooling chamber 20 prior to being dispensed from opening means 14. In this manner, the next-to-be-consumed portion of the beverage is quickly and efficiently cooled due to the increased ratio of volume (of beverage) to area (of heat transfer wall). The directing means 28 can be made of any material but is suitably a metal or plastic affixed to the top of container 10.

One advantage of the present invention is the ability to manufacture container 10 using conventional manufacturer materials and equipment with minimal adaptation. For example, container 10 can be manufactured with conventional can manufacturing technology by preforming hollow body 12 with cooling chamber 20, preforming the top of container 10 which can have the directing means 28 as a integral part thereof or as a separate unit to be placed thereon, inserting the cooling means into cooling chamber 20 which can be either separately manufactured as a preformed unit or assembled within cooling chamber 20, and then inserting the top and separator means 20 into the hollow body. After sealing container 10 with conventional techniques, the openable closure means 18 can be placed on the container using conventional technology.

The operation of the present self-cooling container 10 is particularly simple lending it to quick consumer acceptance. As desired, the consumer lifts or removes the openable closure means 18, applies pressure to the flexible rolling diaphragm 30 with their finger thereby causing a pressure to be exerted upon and rupturing the rupturable separator means 26. Once the rupturable separator means 26 is ruptured, the chemical from compartment 24 enters compartment 22 and reacts with the liquid in compartment 22. The resulting endothermic reaction cools the beverage. The beverage is consumed through opening means 14 after opening.

It is important to note that rupturable separator means 26 has sufficient durability to keep the contents of compartment 22 and compartment 24 from coming into contact during normal handling. On the other hand, rupturable separator means 26 must be capable of rupturing upon the exertion of pressure. Typically, the rupturable separator means can be any thin material or membrane such as rubbers, elastomers, films, resins, plastics or the like. Preferably the material is a elastomer which is stretched or drawn so as to have limited flexibility yet not rupture during normal handling. Optionally, mechanical mixing means for increasing the mixing of the chemical and the liquid can be employed in compartment 24.

Figure 4:
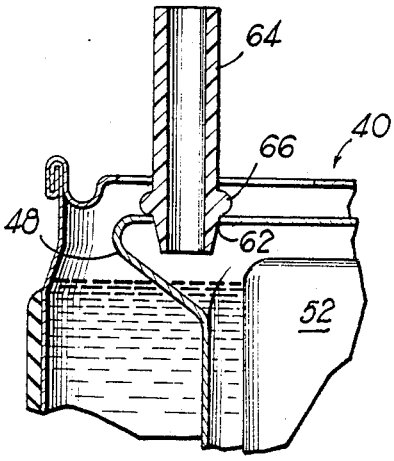
FIG. 4 is an enlarged partial cross-sectional side view of the self-cooling container of FIG. 3.
Figure 3:
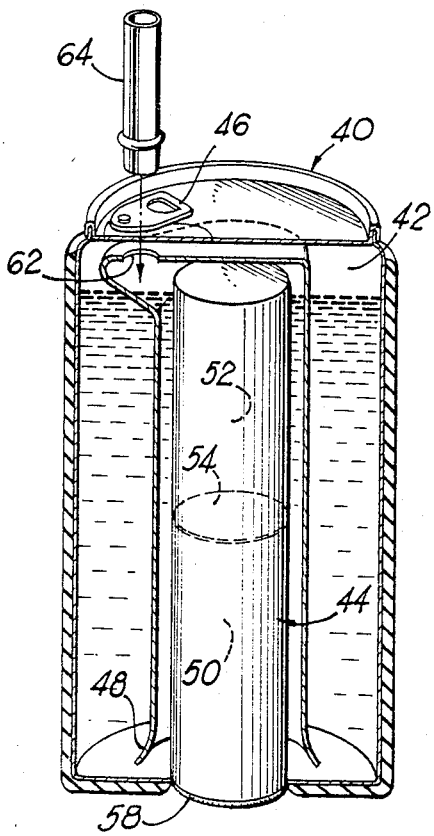
FIG. 3 is a perspective cross-sectional side view of another embodiment of the present invention.

FIGS. 3 and 4 show another embodiment of the present invention which utilizes a directed flow to cool the next-to-be-consumed portion of the beverage. Accordingly, container 40 has hollow body 42, cooling chamber 44, opening means 46 and directing means 48. The cooling chamber 44 his compartments 50 and 52 separated by rupturable separator means 54 and is adjacent to openable closure means 56. Compartment 50 containing the liquid is in contact with the flexible rolling diaphragm 58. Compartment 50 contains a chemical. The cooling chamber 44 is similar to that shown in FIGS. 1 and 2 (20).

Circling cooling chamber 44 is directing means 48 which forms a "skirt" or a "cup" around the cooling chamber 44. The directing means 48 is affixed to container 40 by any suitable means as known to those skilled in the art. The top of directing means 48 has a projecting lip and a hole 62 for the insertion of a drinking tube 64, suitably a metal or plastic straw. The drinking tube 64 has stoppers 66 extending horizontally outward to stop the insertion of drinking tube 64 so as not to prohibit the flow of beverage if inserted against separator means 48. The directing means 48, made from a suitable material such as metal or plastic, directs the flow of beverage between the directing means 48 and the cooling chamber 44 prior to exiting through the drinking tube 64.

FIG. 4 shows a sectional enlargement of the top half of container 40. The drinking tube 64 is shown inserted into opening means 46 and the hole 62 of directing means 48.

The operation of container 40 is generally similar to that of container 10 of FIG. 1. The consumer opens or removes openable closure means 56, applies pressure to flexible rolling diaphragm 58 which ruptures the rupturable separator means 54 and allows the liquid and chemical from compartments 50 and 52 to mix. The drinking tube 64 is attached to container 40 in a sanitary plastic wrapper or the like. The consumer opens opening means 46, detaches the drinking tube 64, opens the wrapper, and inserts drinking tube 64 into hole 62. The drinking tube 64 draws the beverage from between directing means 48 and cooling chamber 44 which is cooled as it passes upward. Preferably, there are attachment means (not shown) which keep the drinking tube 64 in contact with the container 40 resulting in the separator means acting like a giant straw.

Figure 5:
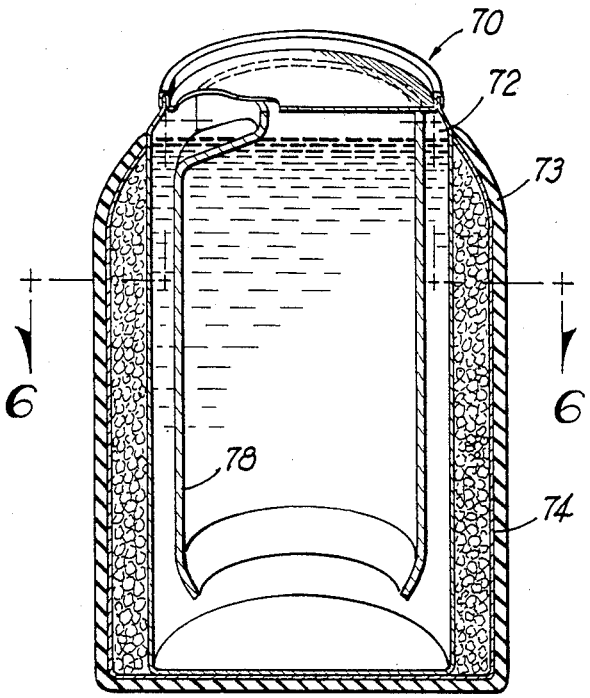
FIG. 5 is a perspective cross-sectional side view of another embodiment of this invention.
Figure 6:
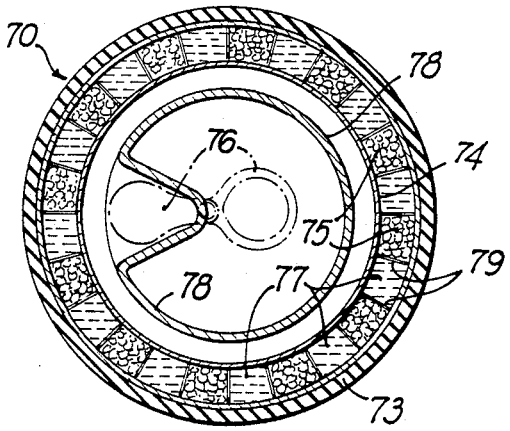
FIG. 6 is a top view of the separator in the self-cooling container of FIG. 5.

FIG. 5 and 6 show another embodiment of the present invention. Container 70 has hollow body 72, cooling chamber 74, opening means 76 and directing means 78. The cooling chamber 74 is a continuous member circling the external wall of the hollow body 72 enclosed by an optional insulating means 73. Typically, the cooling chamber 74 will have at least two separate compartments 75 and 77 and a rupturable separator means 79 made from a pliable material. The cooling means is typically two chemicals or a chemical and a liquid as employed in the cooling chambers herein. Such cooling chambers are known in the art and are employed at remote locations to provide cold or heat treatments. Typical applications for such cooling chambers include injury treatment at sporting events.

The directing means 78 has a cup-like shape and extends from the top of container 70, and stops short of the bottom of container 70. FIG. 6 shows the configuration of the directing means 78 and the relationship of opening means 76 from a top view. The directing means 78 is positioned so as to provide a narrow annular space between it and the external wall of hollow body 72.

The operation of this embodiment is extremely simple. The consumer will squeeze cooling chamber 74 to rupture the rupturable separator means 79 therein, thereby allowing the cooling means to be actuated. The container 70 is opened through opening means 76 where the beverage is dispensed. The beverage flows along the annular space between the directing means 78 and the outside wall of hollow body 72 and is cooled prior to exiting opening means 76.

Figure 7:
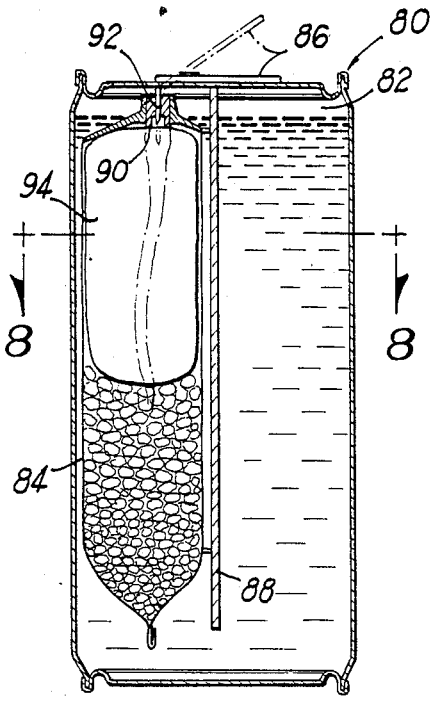
FIG. 7 is perspective cross-sectional side view of yet another embodiment of the present invention.
Figure 8:
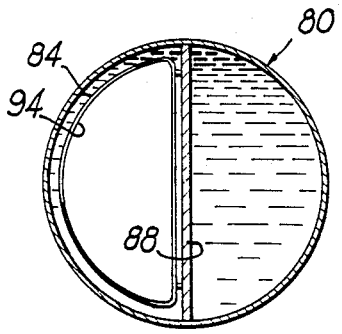
FIG. 8 is a cross-sectional top view of the self-cooling container in FIG. 7.

FIG. 7 and 8 show a self-cooling container which is specifically adapted to activate the cooling mechanism upon opening the container. Accordingly, container 80 has a hollow body 82, a cooling chamber 84, a opening means 86 and a directing means 88. The cooling chamber 84 is preferably a metal tube, such as a toothpaste tube, which is affixed to the top of container 80 by any suitable means. The cooling chamber 84 contains a chemical and an elastomer 94 filled with a liquid. Typically, the elastomer 94 is a balloon or other puncturable material which can be filled with a liquid and then placed into the cooling chamber 84 prior to being inserted in hollow body 82. The top of cooling chamber 84 has a plug 90 which forms a seal between the cooling chamber 84 and the hollow body 82. Within plug 90 is an actuation pin 92 wherein the cutting end is positioned in close proximity to elastomer 86. The directing means 88 extends across the circumference of hollow body 82 from the top of hollow body 82 to a position short of the bottom of hollow body 82.

Again, the operation of container 80 is very simple. The consumer simply opens the opening means 86 which exerts a force upon actuation pin 92 which in turn punctures elastomer 94. The liquid in elastomer 86 mixes with the chemical in cooling chamber 84 to cause the endothermic reaction. The beverage flows up between the cooling chamber 84 and both the outside wall of hollow body 82 and the directing means 88 prior to existing opening means 86.

Figure 9:
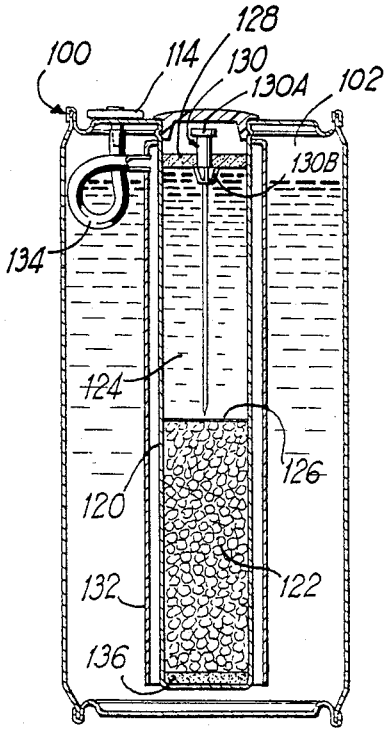
FIG. 9 is a perspective cross-sectional side view of yet another embodiment of the present invention.

FIG. 9 is another embodiment of the present invention which utilizes a chemical mixing means to increase the rate of mixing of the chemical and the liquid in the cooling chamber. The container 100 has hollow body 102, opening means 114, cooling chamber 120, opening closure means 118, directing means 132, and a drinking tube 134. The drinking tube 134, made from any flexible material, is accessible through opening means 114 and attached to directing means 132. The directing means 132 forms a "skirt" or "cup" around the cooling chamber 120, is attached to the top thereof and comes to a position short of the bottom of container 100.

The cooling chamber 120 has compartments 122 and 124 which are separated by separator means 126. The compartments 122 and 124 contain a chemical and a liquid, respectively, which react to absorb heat when in contact. The cooling chamber 120 has a gas permeable membrane 128 and an actuation pin 130 which passes through gas permeable membrane 128, through the liquid in compartment 124 and rests with the cutting end in close proximity to rupturable separator means 126. Activation pin 130 is accessible through opening closure means 118.

The compartment 122 has a chemical for reacting with the liquid in compartment 124 and also contains a suitable chemical mixing means 136 which, when in contact with the liquid, will react to evolve gas. The gas so evolved will bubble up through the mixture and expedite the mixing of the chemical and the liquid. The evolved gas is then vented through gas permeable membrane 128 and openable closure means 118.

The chemical mixing means 136 can include any chemical which, when in contact with a suitable liquid such as water, will evolve a non-toxic gas. Preferred chemical mixing means 136 include non-toxic salts, such as alkali metal carbonates, and organic acids with baking soda (sodium bicarbonate) and citric acid being especially preferred when the liquid is water.

The actuation pin 130 preferably has a vertically extending cap 130A which keeps the actuation pin 130 from being pushed through the gas permeable membrane 126. Collapsible prongs 130B are preferably provided which collapse during insertion and serve to retain the actuation pin 130 from being removed.

The gas permeable membrane 128 can be any pourous material which will form a seal with the actuation pin 130, allow the penetration of gas and retain the liquid in compartment 124. Examples of such materials include gas permeable resins, films, elastomers and polymers. Such materials are known in the art.

The operation of self-cooling container 100 is as follows. The consumer opens or removes the openable closure means 118, applies pressure to actuation pin 130 which punctures rupturable separator means 126 allowing the liquid, chemical, and chemical mixing means 136 to mix. The gas evolved from the chemical mixing means 136 is vented to atmosphere through gas permeable membrane 128. The consumer then opens opening means 114 and pulls out drinking tube 134. The beverage is drawn up from the bottom of the container 100, in between the directing means 132 and the cooling chamber 120 and out through drinking tube 134.

A major advantage of all of the embodiments of the present invention is the directed cooling of a predetermined portion of the beverage by employing means for directing the beverage flow. The present invention reduces the volume to surface area ratio of the predetermined amount of beverage being cooled by controlling or directing the flow of beverage past the cooling chamber prior to exiting the container. In this manner, the cooling is directed to the next-to-be-consumed portion of the beverage reducing the waiting time required for the consumer to drink cold beverage.

While the preferred form of the present invention has been shown and described above, it should be apparent to those skilled in the art that the subject invention includes modifications, variations and equivalents that fall within the scope the attached claims.

What is claimed is:

1. A self-cooling container comprising:
(a) a hollow body for the storage of a beverage,
(b) opening means on said hollow body for providing an opening therein for dispensing said beverage therethrough,
(c) a cooling chamber within said hollow body and affixed thereto and having cooling means therein, and
(d) a directing means within said hollow body for directing said beverage to flow into direct contact with said cooling chamber prior to being dispensed from said container.

2. The container of claim 1 wherein said directing means limits the access of said beverage to said opening means.

3. The container of claim 2 wherein said directing means comprises an elongated member inside of said body and extending vertically downwardly from the top of said container.

4. The container of claim 3 wherein said directing means is a separator extending across the circumference of said container from the top of said container to a point short of the bottom of said container allowing sufficient flow of said beverage to said opening means.

5. The container of claim 4 wherein said separator is an integral part of the top of said container.

6. The container of claim 2 wherein said separator comprises a cup having a base with the base of said cup affixed to the top of said hollow body.

7. The container of claim 6 wherein said cup includes an indented portion running vertically along said cup to allow access of said beverage to said opening means.

8. The container of claim 6 wherein said cup is around said cooling chamber and said beverage is drawn from between said cup and said cooling chamber to said opening means.

9. The container of claim 8 wherein a drinking tube is inserted into said opening means for drawing said beverage.

10. The container of claim 1 wherein said cooling chamber comprises a first compartment containing a liquid and a second compartment containing a chemical that will react when contacted with said liquid separated by a rupturable separator means and means for rupturing said rupturable separator means.

11. The container of claim 10 wherein said means for rupturing is connected to said first compartment.

12. The container of claim 11 wherein said means for rupturing are accessible through an openable closure means located on said hollow body and adjacent to said cooling chamber.

13. The container of claim 12 wherein said means for rupturing includes a flexible wall forming a part of said first compartment.

14. The container of claim 13 wherein said flexible wall can be pushed inward to create sufficient pressure on said liquid to rupture said rupturable separator means.

15. The container of claim 14 wherein said flexible wall includes a flexible rolling diaphragm.

16. The container of claim 13 including a cutting member connected to said flexible wall for rupturing said rupturable separator means when said cutting member is placed in contact with said rupturable separator means.

17. The container of claim 16 wherein said cutting member is a pin.

18. The container of claim 13 wherein said flexible wall is a gas permeable membrane and said second compartment includes a chemical mixing means.

19. The container of claim 10 wherein said first compartment is an elastomer balloon inserted into said cooling chamber.

20. The container of claim 19 including a cutting member connected to said opening means for rupturing said elastomer balloon when said opening means is opened.

21. A self-cooling container comprising:
(a) a hollow body for the storage of a beverage having first and second ends,
(b) opening means on said first end for dispensing said beverage,
(c) a cooling chamber within said hollow body and affixed to said second end having cooling means therein, and
(d) directing means comprising a cup inserted over said cooling chamber, the base of said cup affixed to said first end, said cup having an opening in alignment with said opening means and positioned to direct said beverage along said cooling chamber and out through said opening means.

22. The container of claim 21 wherein said container includes a drinking tube inserted into said opening means and into said opening of said directing means for drawing said beverage pass said cooling chamber and out of said hollow body.

23. The container of claim 22 wherein said opening is located on an horizontally extending base on said cup.

24. The container of claim 21 wherein said cooling chamber comprises a first compartment containing a liquid and a second compartment containing a chemical that will react when contacted with said liquid separated by a rupturable separator means and means for rupturing said rupturable separator means.

25. The container of claim 24 wherein said means for rupturing is connected to said first compartment.

26. The container of claim 25 wherein said means for rupturing are accessible through a openable closure means located on said hollow body and adjacent to said cooling chamber.

27. The container of claim 26 wherein said means for rupturing includes a flexible wall forming a part of said first compartment.

28. The container of claim 27 wherein said flexible wall can be pushed inward to create sufficient pressure on said liquid to rupture said rupturable separator means.

29. The container of claim 28 wherein said flexible wall includes a flexible rolling diaphragm.

* * * * *